US005160946A

United States Patent [19]

Hwang

[11] Patent Number: 5,160,946

[45] Date of Patent: Nov. 3, 1992

[54] IMAGE REGISTRATION SYSTEM

[75] Inventor: Shyshung S. Hwang, Penfield, N.Y.

[73] Assignee: Xerox Corporation, Stamford, Conn.

[21] Appl. No.: 732,536

[22] Filed: Jul. 19, 1991

[51] Int. Cl.[5] ..... G03G 15/01; G03G 15/04

[52] U.S. Cl. ..... 346/157; 355/244; 355/327

[58] Field of Search ..... 346/157; 355/244, 327

[56] References Cited

U.S. PATENT DOCUMENTS

| | | | |
|---|---|---|---|
| Re. 32,967 | 6/1989 | St. John et al. | 242/57.1 |
| 4,188,110 | 2/1980 | Stange | 355/3 BE |
| 4,401,024 | 8/1983 | Frentress | 101/93.01 |
| 4,569,584 | 2/1986 | St. John et al. | 355/14 |
| 4,641,070 | 2/1987 | Pfizenmaier et al. | 318/640 |
| 4,698,514 | 10/1987 | Hilmersson et al. | 250/566 |
| 4,804,979 | 2/1989 | Kamas et al. | 346/157 |
| 4,821,066 | 4/1989 | Foote, Jr. et al. | 355/14 |
| 4,847,660 | 7/1989 | Wheatley et al. | 355/244 |
| 4,903,067 | 2/1990 | Murayama et al. | 346/160 |
| 4,912,491 | 3/1990 | Hoshino et al. | 346/160 |
| 4,916,547 | 4/1990 | Katsumata et al. | 358/300 |
| 4,935,788 | 6/1990 | Fantuzzo | 355/326 |
| 4,963,899 | 10/1990 | Resch, III | 346/157 |
| 4,965,597 | 10/1990 | Ohigashi et al. | 346/157 |
| 5,016,062 | 5/1991 | Rapkin | 355/327 |
| 5,119,140 | 6/1992 | Berkes et al. | 355/326 X |

*Primary Examiner*—George H. Miller, Jr.

[57] ABSTRACT

An electrophotographic printing machine utilizes an improved image registration system that forms and senses image registration indicia to control a subsequent transfer of a visible image. A first transfer station transfers registration indicia, previously formed on a first photoconductive member and transferred therefrom, onto a receiving member. A sensor monitors the registration indicia on the receiving member and generates a control signal indicative thereof. A second transfer station, responsive to the control signal, transfers a visible image, previously formed on a second photoconductive member and transferred therefrom, to the receiving member.

30 Claims, 4 Drawing Sheets

IMAGE REGISTRATION SYSTEM

BACKGROUND OF THE INVENTION

1. Field of the Invention

This invention relates generally to an electrophotographic printing system, and more specifically, the present invention is directed to an improved image registration system.

2. Description of the Prior Art

The basic process of monocolor electrophotographic printing (e.g. black image placed on a white background) comprises exposing a charged photoconductive member. The irradiated areas of the photoconductive surface are discharged to record thereon an electrostatic latent image corresponding to the original document. A development system, thereupon, moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. Following the toner image transfer to the sheet of support material, the support material sheet advances to a fuser which permanently affixes the toner powder image thereto.

Essentially, multicolor electrophotographic copying and printing (e.g. several colors placed on a white background) repeats the process of monocolor printing by repeating a plurality of cycles, each cycle being for a different color. Development stations for each of the different colors apply a specific color toner complimentary in color to the color of a filter utilized to produce the irradiated areas of the photoconductive member. The different color toners are generally, cyan, magenta, and yellow (and sometimes black if a true black is desired), which in one combination or another can be used to generate the full spectrum of visible colors.

Through the application of the different colored toners at the respective stations, a plurality of color toner powder images are formed for transfer directly to a sheet of support material or to an intermediate belt for subsequent transfer to a sheet of support material. In either case the images are transferred in superimposed registration with one another. After a plurality of different color toner powder images have been transferred to the sheet of support material in superimposed registration with one another, the multicolor toner powder image is permanently affixed thereto.

In recent years, there have been demands for providing high quality images. In order to achieve a full color reproduction using electrophotographic color printing, it is critical that the toner powder images be superimposed upon each other on the copy in near perfect registry. For example, image registration of at least 0.005 inches is required to minimize blur and color hue shifts.

In view of the importance of color reproduction capabilities and the emphasis on overall quality there is a need for an improved image registration system.

The following disclosures may be relevant to various aspects of the present invention:

US-A-4,188,110
Patentee: Stange
Issued: February 12, 1980
US-A-4,401,024
Patentee: Frentress -continued Issued: August 30, 1983
US-A-4,804,979
Patentee: Kamas et al.
Issued: February 14, 1989
US-A-4,847,660
Patentee: Wheatley, Jr. et al.
Issued: July 11, 1989
US-A-4,903,067
Patentee: Murayama et al.
Issued: February 20, 1990
US-A-4,916,547
Patentee: Katsumata et al.
Issued: April 10, 1990
US-A-4,935,788
Patentee: Fantuzzo
Issued: June 19, 1990
US-A-4,963,899
Patentee: Resch, III
Issued: October 16, 1990
US-A-4,965,597
Patentee: Ohigashi et al.
Issued: October 23, 1990
US-A-5,016,062
Patentee: Alan E. Rapkin
Issued: May 14, 1991

The relevant portions of the foregoing disclosures may be briefly summarized as follows:

U.S. Pat. No. 4,963,899 discloses a method and apparatus for image frame registration in which registration indicia for registering an image frame are written on a photosensitive member in an interframe or frame margin area. A sensor array provides in-track and cross-track signal information to a control unit for synchronizing the electrostatic process of the registered image frames.

U.S. Pat. No. 4,916,547 discloses a color image forming apparatus which produces a single composite color image on a paper. The paper is transported by a belt and the composite color image is formed by transferring image components of different colors to the paper in register with each other. The apparatus reduces positional deviation of a plurality of image components of different colors by sensing signals on a surface of the transfer belt outside a paper region. The sensor senses arriving pattern images and corrects for unaligned images by calculating a deviation amount and adjusting a timing signal accordingly.

U.S. Pat. No. 4,847,660 discloses a method and apparatus for registration control in an electrophotographic printing machine. A plurality of separate image creation and developmental control signals are regulated by a timing clock which senses reference pulses generated upon arrival of a transfer belt at each reference station. The image creation can be temporally synchronized with the physical rotation of the belt assuring proper image registration.

U.S. Pat. No. 4,804,979 discloses a single pass color printer/plotter having four separate microprocessor-based print stations, each for printing a different color image for superimposition with one another to form a full color image. The printer includes a registration system where each print station monitors registration marks to correct for media variations. Each print station includes optical sensors that monitor the marks printed on the media edge to synchronize the printing and align the images properly.

U.S. Pat. No. 4,401,024 discloses a method and apparatus for establishing and maintaining registration control in a printing system which prints an image on a moving substrate. Registration marks are printed and sensed along the length of the substrate. These marks are used to correct for a misalignment that can occur during the transfer to subsequent print stations, thus, creating a clearer image.

U.S. Pat. No. 4,965,597 discloses a color image recording apparatus which superimposes a plurality of different color images on one another to form a composite image. Registration marks are formed on a recording medium and are sensed at each station to assure a clear and accurate superimposed image. A sensor senses one or both edges of a recording medium to note image deviations caused by transport to enable compensation thereof.

U.S. Pat. No. 4,903,067 discloses a multi-image forming apparatus in which image registration marks are formed to detect the position of different color images. The registration marks are formed on a transfer belt at regular intervals and separate from the different color images. CCD detectors sense the marks and accurately correct for any deviations that may occur along the transfer path.

U.S. Pat. No. 5,016,062 discloses an apparatus for forming multicolor toner images. A plurality of imaging members develop different color toner images. A transferring means transfers the different colored images in registration to either an endless web or receiving sheet carried by the web. The web contains perforations along an edge and a means is provided to maintain sprocket teeth within the perforations to maintain accurate registration.

U.S. Pat. No. 4,188,110 discloses a high speed color reproduction machine comprised of four separate xerographic processing units. A precise dimensional relationship, between the photoreceptor length and the spacing for each processing unit, assures registration of produced color images with one another.

U.S. Pat. No. 4,935,788 discloses a multicolor printing system in which a plurality of different color developed images are transferred to a conveying member in superimposed registration to form a multicolor image.

SUMMARY OF THE INVENTION

Pursuant to the features of one aspect of the present invention, there is provided an apparatus for providing image registration. The apparatus comprises first and second photoconductive members and a receiving member. First means are provided for forming at least visible image registration indicia on the first photoconductive member. Second means are provided for forming a visible image on the second photoconductive member. First means are provided for transferring the visible image registration indicia from the first photoconductive member to the receiving member. Means are provided for sensing the visible image registration indicia on the receiving member and generating a control signal indicative thereof. Second means, responsive to the signal from the sensing means, are provided for transferring the visible image from the second photoconductive member to the receiving member.

Pursuant to the features of another aspect of the present invention, there is provided an electrophotographic printing machine of the type in which image registration is provided for a visible image formed on a photoconductive member and transferred to a receiving member. The improvement comprises first and second photoconductive members and a receiving member. First means are provided for forming at least visible image registration indicia on the first photoconductive member. Second means are provided for forming a visible image on the second photoconductive member. First means are provided for transferring the visible image registration indicia from the first photoconductive member to the receiving member. Means are provided for sensing the visible image registration indicia on the receiving member and generating a control sensing means, are provided for transferring the visible image from the second photoconductive member to the receiving member.

Other features of the present invention will become apparent as the description thereof proceeds and upon reference to the drawings.

BRIEF DESCRIPTION OF THE DRAWINGS

In the detailed description of the preferred embodiments of the present invention, reference is made to the accompanying drawings, in which.

Figure 1:
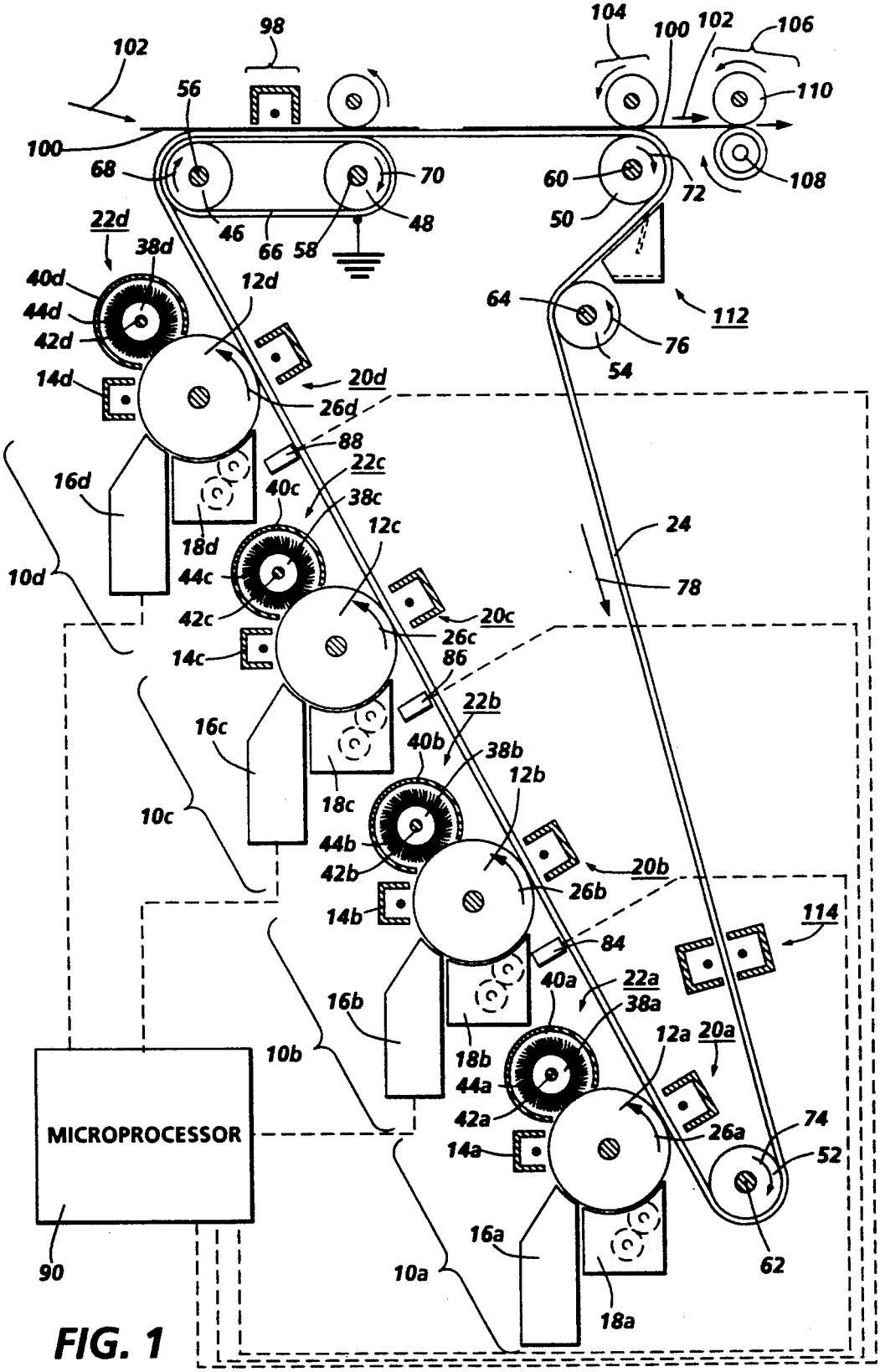
FIG. 1 is a schematic elevational view showing an illustrative electrophotographic printing system incorporating the features of the present invention therein.

In the drawings and the following description, it is to be understood that like numeric designations refer to components of like function. While the present invention will be described in connection with preferred embodiments thereof, it will be understood that it is not intended to cover all alternatives, modifications, and equivalents as may be included within the spirit and scope of the invention as defined by the appended claims.

DETAILED DESCRIPTION OF THE PREFERRED EMBODIMENTS

Although specific terms are used in the following description for the sake of clarity, these terms are intended to refer only to the particular structure of the invention selected for illustration in the drawings, and are not intended to define or limit the scope of the invention.

Several types of electrophotographic printing machines, both color and black and white, have heretofore been proposed and commercialized. Since color is the more complex of the two, a color printing system will be discussed for illustrative purposes. However, it should be understood that the present invention can function in both color and monocolor machines.

A typical color printing apparatus in which the present invention may be used is illustrated in FIG. 1 of the accompanying drawings. As illustrated in FIG. 1, four image forming units, generally designated by reference numerals 10*a*, 10*b*, 10*c* and 10*d*, are disposed and respectively have separate photoconductive members or photoreceptors 12*a*, 12*b*, 12*c*, 12*d* around which are disposed charging stations 14*a*, 14*b*, 14*c*, and 14*d*, exposure stations 16*a*, 16*b*, 16*c* and 16*d*, development stations 18*a*, 18*b*, 18*c* and 18*d*, transfer stations 20*a*, 20*b*, 20*c* and 20*d*, and cleaning stations generally designated by reference numerals 22*a*, 22*b*, 22*c* and 22*d*. A receiving member, such as an endless intermediate belt 24 is disposed through the image forming units 10*a*, 10*b*, 10*c* and 10*d* to receive an image at the respective transfer stations 20*a*, 20*b*, 20*c* and 20*d* of the image forming units 10*a*, 10*b*, 10*c* and 10*d*. Each image forming unit 10*a–d* is positioned closely adjacent the intermediate belt 24 to transfer a successive visible (toner) image thereto in superimposed registration with each preceding image.

In one embodiment, the receiving member may be an intermediate belt 24. The successive visible (toner) images are transferred to the intermediate belt 24 in superimposed registration with one another. After all of the visible images are transferred to the intermediate belt 24, the resulting multi-layer visible image formed thereon is transferred to a sheet of support material and subsequently fused thereto. By way of example, the intermediate belt 24 may be formed of any suitable dielectric material.

Within the typical color printing machine, each photoreceptor 12*a–d*, preferably in the shape of a drum, has a photoconductive surface deposited on a conductive substrate. Preferably, the photoconductive surface is made from a selenium alloy with the conductive substrate being made from an electrically grounded aluminum alloy. Each photoreceptor 12*a–d* is rotatably driven by individual motors (not shown) in the direction of the arrows 26*a–d*, respectively, to advance successive portions of the photoconductive surface through the various processing stations disposed about the path of movement thereof.

Initially, photoreceptors 12*a–d* rotate their respective outer photoconductive surfaces through associated charging stations 14*a–d*, respectively. Each charging station 14*a–d* has a corona generating device (not shown), which is well known in the art. The corona generating devices are positioned closely adjacent to the associated photoreceptors 12*a–d* to sensitize the photoconductive surfaces thereof. The sensitizing of the photoreceptors 12*a–d* is achieved by charging the photoconductive surfaces to a relatively high substantially uniform potential.

Figure 2:
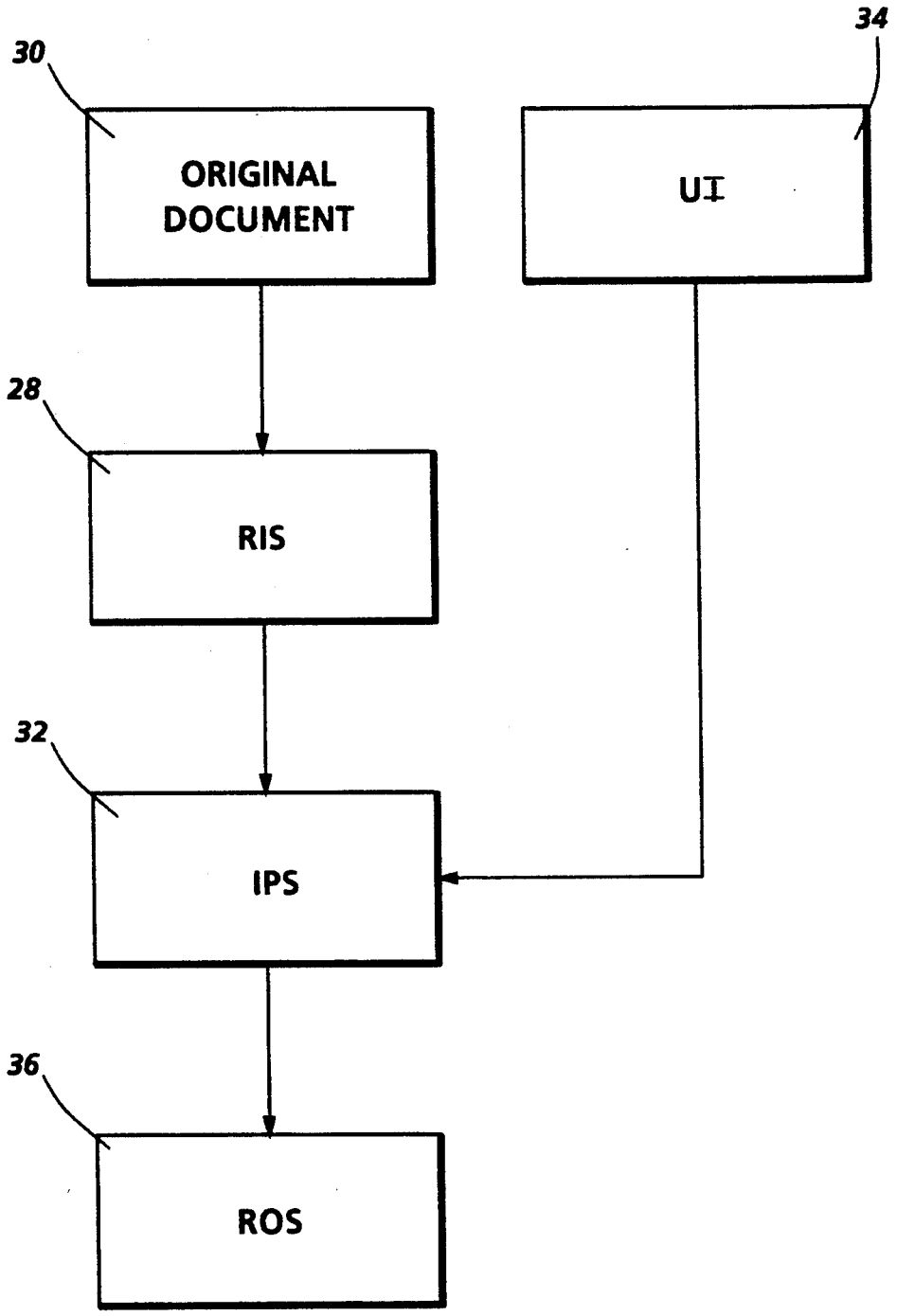
FIG. 2 is a block diagram of the raster input/output device used in the FIG. 1 printing machine.

Thereafter, the sensitized or charged photoconductive surfaces of the respective photoreceptors 12*a–d* are rotated to the exposure stations 16*a–d*. The exposure stations 16*a–d* may be any type of raster input/output scanning device (RIS/ROS). A RIS device typically has document illumination lamps, optics, a scanning drive, and photosensing elements, such as a CCD array, i.e. a charge coupled device. Referring to FIG. 2, a RIS device 28 scans an original document 30 one line at a time generating electrical raster image signals representative of a particular color component in the original document. The RIS 28 captures the image from the original document 30 and converts the image to a series of raster scan lines which are transmitted as electrical signals to an image processing system (IPS) 32. The IPS 32 generates electrical signals according to a prescribed scheme from the raster image signals representative of the original document 30. The conventional circuitry of the IPS 32 is well known to one skilled in the art. A user interface (UI) 34 will generally be in communication with the IPS 32 to enable an operator to control the various operator adjustable functions. A ROS 36 generates a raster image of the original document 30 in response to the electrical signals from the IPS 32. The ROS 36 is typically a moving spot system that exposes the photoreceptors 12*a–d* to a light intensity to record an electrostatic latent image thereon.

Generally, a laser is utilized as the light source for the ROS 36 since it produces a collimated light beam suited for focusing to a small spot, yet, with adequate energy to effectively discharge the photoconductors 12*a–d*. Alternatively, the ROS 36 may utilize a light emitting diode array to generate light spots.

It should be understood the exposure stations 16*a–d* are not limited to RIS/ROS combinations. For instance, an ROS could be interfaced with a microprocessor in which data can be inputted therein by use of a keyboard terminal. The microprocessor would then generate an electrical signal representative of the inputted data. The ROS, responsive to the electrical signals of the microprocessor, would then generate a raster image, representative of the data stored in the microprocessor, to record an electrostatic latent image on a selected one of the photoreceptors 12*a–d*.

Alternatively, the exposure stations 16*a–d* could utilize a light/lens system. The exposure stations would typically have a common exposure lamp which shines a light onto an original document. The light is reflected off the document passing through different filters which transmit light according to compliment of the color used in a development stage. Each of the filters directs the light to the different exposing stations 16*a–d* where the filter light is redirected by a first mirror through a lens where the light is focused. The light passes through lens to a second mirror where it is redirected to an associated photoreceptor to record an electrostatic latent image thereon.

Continuing with the discussion of FIG. 1, after the electrostatic latent images have been recorded on the photoreceptors 12*a–d*, the photoreceptors 12*a–d* rotate to advance such latent images to development stations 18*a–d*. The developer units can be various types but are generally what is referred to in the art as "magnetic brush development units." Typically, a magnetic brush development system employs a magnetizable developer material (not shown) including magnetic carrier granules having toner particles adhering triboelectrically thereto. The developer material is continually brought through a directional flux field to form a brush (not shown) of developer material. The developer material is constantly moving so as to continually provide the brush with fresh developer material. Development is achieved by bringing the brush of developer material into contact with the photoconductive surface. The developing stations 18*a–d*, respectively, apply toner particles of a specific color which corresponds to the compliment of the specific color separated electrostatic latent image recorded on the respective photoreceptors 12*a–d*. The color of each of the toner particles is adapted to absorb light within a preselected spectral region of the electromagnetic wave spectrum. For example, an electrostatic latent image formed by discharging the portions of charge on the photoreceptor 12*c* corresponding to the green regions of the original document 30 will record the red and blue portions as areas of relatively high charge density on the photoconductive surface, while the green areas will be reduced to a voltage level ineffective for development. (Please note that document 30 is shown only in FIG. 2). The charged areas are then made visible by having the developing station 18*c* apply green absorbing (magenta) toner particles onto the electrostatic latent image recorded on the photoreceptor 12*c*. Similarly, a blue color separation of the original document 30 is developed by developing station 18*b* with blue absorbing (yellow) toner particles, while the red separation is developed by developing station 18*d* with red absorbing (cyan) toner particles. The other developing station 18*a* contains black toner particles and may be used to develop the electrostatic latent image formed from a black and white original document, to provide a true black, and to provide a high contrast color for image registration indicia placed along side an image.

After development, the toner image is moved past an associated transfer station 20*a–d*. The transfer stations 20*a–d* include a corona generating device which attracts charged toner powder images from the photoreceptors 12*a–d* to the closely adjacent intermediate belt 24. During transfer, each transfer station 20*a–d* transfers a developed image to the intermediate belt 24. The transfer stations 20*a–d* are energized sequentially so that successive different color developed images are transferred in superimposed registration with one another.

After completion of the image transfer from the separate photoreceptors 12*a–d* to the intermediate belt 24, the photoreceptors 12*a–d* are cleaned by the cleaning stations 22*a–d* to remove any residual toners therefrom, thus becoming ready for the next cycle of latent image formation and development. The cleaning stations 22*a–d* include cleaning rollers 38*a–d*, respectively, formed of any appropriate synthetic resin and driven in a direction opposite to the direction of photoreceptors 12*a–d*. The rollers 38*a–d* are disposed in housings 40*a–d*, respectively. Suitable journaling means 42*a–d* supports the respective rollers 38*a–d* for rotation such that bristles 44*a–d*, extending outward from the respective rollers 38*a–d* are in wiping contact with the photoconductive surface of the respective photoreceptors 12*a–d*. Leftover developing material and any other debris is carried from the housings 40*a–d* by means of suction to a vacuum exhaust duct (not shown).

Having described the individual components of the four imaging units 10*a–d*, their operation will now be described in relation to the specific subject matter of the present invention. An electrostatic latent first image, preferably of a black component color, corresponding to the image of an original is first formed on the photoreceptor 12*a* by conventional electrophotographic means utilizing the charging station 14*a* and exposure station 16*a* of the first image forming unit 10*a*.

The apparatus of the present invention, concurrently with the formation of the electrostatic latent first image, also forms electrostatic latent image registration indicia on the photoreceptor 12*a*. The image registration indicia is placed on the photoreceptor 12*a* in the non-image region, i.e. outside the first image also placed thereon. The image registration indicia can be a variety of marks including bar codes or spaced apart lines preferably extending the length of one or both edges of the first image. The image registration indicia can be formed in any manner similar to that known in the art for forming an image on the photoreceptor 12*a*. For example, as known in the art, the RIS 28 generates electrical raster image signals corresponding to information derived from the original. Thereafter, the IPS 32 typically generates electrical signals according to a prescribed scheme from the raster image signals representative of the original 30. The IPS 32 of the apparatus of the present invention, in addition to forming electrical signals from the raster signals representative of the original, also generates electrical image registration signals derived from the raster image signals representative of the original according to a prescribed scheme. In response, the ROS 36 not only generates a raster image but also image registration indicia to expose the photoreceptor 12*a* to a light intensity to record the first latent image and image registration indicia thereon.

After the electrostatic latent images of the first image and image registration indicia have been recorded on the photoreceptor 12*a*, the photoreceptor 12*a* is advanced to the development station. At the development station 12*a*, the electrostatic latent first image and the electrostatic latent image registration indicia are developed to form a first visible image and visible image registration indicia. The photoreceptor 12*a*, then advances to the transfer station 20*a*, where the first visible image and visible image registration indicia are transferred to the intermediate belt 24. Since the visible image registration indicia is formed in a non-image region on the photoreceptor 12*a*, the indicia will be transferred to a non-image region on the intermediate belt 24.

The intermediate belt 24 is supported by rollers 46, 48, 50, and 52 causing the intermediate belt 24 to form a generally triangular shape except the side extending from roller 50 to 52 is projected inward by a roller 54 exterior to the "triangle" formed by the intermediate belt 24. Each of the rollers 46, 48, 50, 52 and 54 are rotatably supported by suitable journaling means, 56, 58, 60, 62 and 64, respectively. In addition rollers 46 and 48 are connected by a belt 66 wrapped about both rollers. At least one roller is drivingly coupled to at least one suitable servo or step motor (not shown). The motor, when actuated, rotates rollers 46, 48, 50, 52 and 54 for a predetermined interval in the direction of arrows 68, 70, 72, 74 and 76 to advance the intermediate belt 24 in the direction of arrow 78 as illustrated in FIG. 1.

Figure 3:
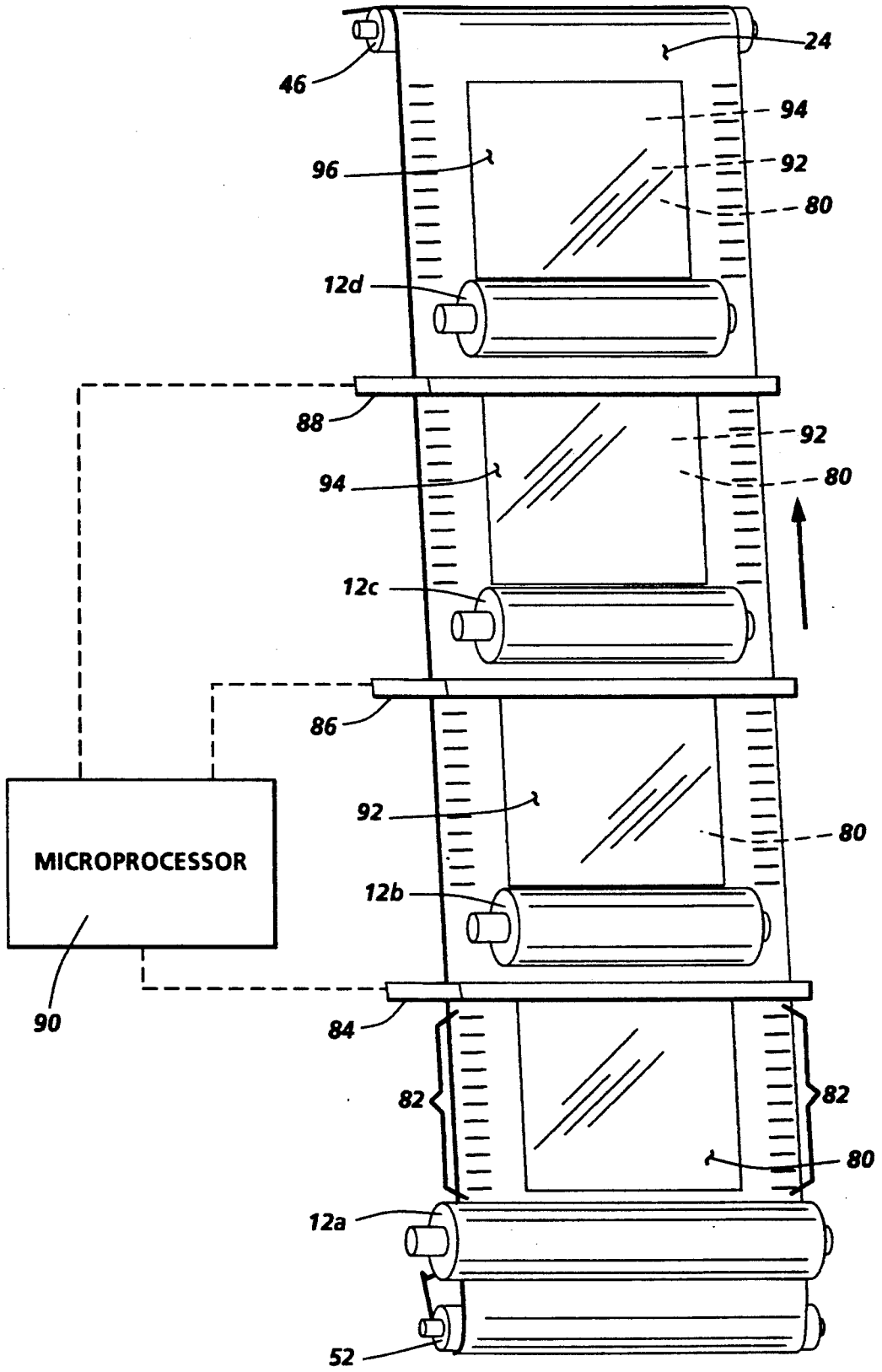
FIG. 3 is a schematic perspective view showing the placement of registration indicia.

Referring also to FIG. 3, a first visible (black toner) image 80 image registration (black toner) indicia 82 are transferred to the intermediate belt 24, as the intermediate belt 24 advances beneath the first image forming unit 10*a*. As the intermediate belt advances to the second image forming unit 10*b*, the intermediate belt 24 passes beneath a first image registration sensor 84. The first image registration sensor 84 is typical of the sensors positioned between each image forming unit. The first image registration indicia sensor 84 is positioned between the first and second image forming units 10*a* and 10*b*. Between the second and third image forming units 10*b* and 10*c* is a second image registration sensor 86. Between the third and the fourth image forming unit is a third image registration indicia sensor 88. Thus, as the intermediate belt 24 advances to a later image forming unit 10, the newly-written image registration indicia 82 will accordingly pass under one of the image registration sensors 84, 86 and 88.

A variety of sensors known in the art can be used to monitor the image registration indicia 82, for example, optical sensors. Since the image registration indicia 82 have been developed, the line patterns thereof are optically readable by illuminating the line patterns with a light emitter and sensing the patterns of reflected light. In one embodiment, each of the sensors 84, 86, and 88 would be divided into subsections comprising known photoemitter/photosensor pairs. A plurality of the pairs are arranged in a linear fashion along the length of the sensor array in a single bar-type device. Preferably, the emitter/sensor pair is in close proximity because the reflected light pattern is more precisely detected by such a device. Alternatively, if the intermediate belt 24 is transparent, the emitter/sensor pair can be separated by the intermediate belt 24. The toned image registration indicia 82 would then pass between the pair and provide a pattern of transmitted light.

In alternative embodiment, the toner used in the development station 18*a* could be magnetic and a magnetic sensor could be used in lieu of an optical sensor. Each of the sensors 84, 86, and 88 would preferably comprise a plurality of discrete sensors. Each discrete sensor would be responsive to the presence or absence of the magnetic field generated by the image registration indicia 82. During the passage of the image registration indicia 82 beneath each discrete sensor, the magnetic field variations exhibited by the moving line patterns would be sensed by the discrete sensors. In this instance, the magnetic toner is magnetized prior to passing beneath each of the sensors 84, 86 and 88.

However, a disadvantage of magnetic toner is that it is not generally practicable in a multicolor system. The magnetic toner typically consists of carbon magnetizable metal particles and the like. The carbon particles make the toner black. Regardless, of how the magnetic black particles are mixed with a color toner, the magnetic toner will normally become visible, making a color transparency impracticable.

The scope of the invention should not be limited to the aforementioned types of sensors but instead include any desirable sensor known in the art.

The image registration indicia 82 are preferably patterns of spaced apart lines which extend the length of one or both sides of the first visible first image 80. Since the the indicia 82 extends the full length of the side of the visible image 80, each of the sensors 84, 86 and 88 is able to generate a control signal indicative of the entire visible image 80 (as well as other images such as images 92, 94 and 96 if transferred prior to sensing). Thus, because the indicia 82 extends the full length of the side of the visible image 80, the sensors 84, 86 and 88 not only determine discrepancies between image frames as is customarily achieved with indicia aligned with a leading edge of the frame, but also can determine discrepancies within an image frame. Regardless of the type of sensor used, each of the sensors 84, 86 and 88 monitor the image registration indicia 82 and provide a control signal to a microprocessor 90 at the detection of each line indicative of the indicia pattern. The microprocessor 90 then functions to adjust the timing of the write or image operation of the second image forming unit 10*b* to assure accurate registration of the first visible image 82 with the second visible (yellow toner) image 92. The registration errors corrected by sensor are typically due to variations in speed of the intermediate belt 24, the variation of which can be typically as high as 5%. (In the case where a sheet of transfer paper is carried by the receiving member, registration errors can be additionally due to variations in paper.) According to a predetermined timing sequence, the microprocessor 90 expects the individual line patterns to arrive beneath each of the sensors 84, 86 and 88 at an exact interval of time in order to assure correct registration of the visible images. If the lines of the registration indicia 82 appear too early or too late, the microprocessor adjusts the write operation of the next image forming unit, in this case, image forming unit 10*b*.

The spatial period of the lines of the image registration indicia 82 should be smaller than the distance between corresponding exposing and transfer stations, 16*a–d* and 20*a–d*, respectively. Furthermore, the distance between a sensor (one of sensors 84, 86 and 88) and the following transfer station (one of transfer stations 20*b–d*) should be slightly larger than the distance between the exposure and transfer stations, 16*a–d* and 20*a–d*, respectively, to allow time for the data processing of the microprocessor 90.

The microprocessor 90 can adjust the timing of the write operation of one of the image forming units 10*a–d* in several ways. The IPS 32, which generates electrical signals from the raster image representative of the original, can be adapted to include a signal generating timing mechanism (not shown) controlled by the microprocessor 90. The microprocessor 90, through the timing mechanism of the IPS 32, is thereby able to determine the timing of when the ROS 36 exposes the photoreceptor 12*a–d* to record an electrostatic latent image thereon.

Alternatively, the microprocessor 90 can be electrically connected to the motor which drives the rotation of the photoreceptor 12*a–d*. Thereby, the microprocessor 90 can adjust the speed of the rotation of the photoreceptor 12*a–d* to control the timing of the recording of the electrostatic latent image upon the photoreceptor 12*a–d*.

As an alternative and/or additional registration correction means the microprocessor 90 can be electrically connected to the motor or motors which drive the driving roller or rollers, which in turn, drive the rotation of the intermediate belt 24. The motor can have a variable speed function to allow the intermediate belt to advance at variable speeds. Thereby, the microprocessor 90 can adjust the speed of the rotation of the intermediate belt 24 to control the time of the transfer of the developed toner image to the intermediate belt 24.

Referring back to the alternative in which the timing of the image recording is adjusted, the microprocessor 90 controls the timing when the latent image of a yellow component color is formed in the second image forming unit 10*b*. Subsequently, a yellow toner image is obtained at the developing station 18*b*. When the portion of the intermediate belt 24, to which the first visible (black toner) image has been transferred thereto, advances to the transfer station 20*b* of the second image forming unit 10*b*, the second visible (yellow toner) image 92 is transferred in superimposed registration with the first visible (black toner) image 80. The image recording timing prescribed by the microprocessor 90 assures correct timing of the transfer and thus correct image registration.

Thereafter, within the magenta and cyan color image forming units 10*c* and 10*d*, respectively, image formation is carried out in a similar manner. The second image registration sensor 86 monitors the image registration indicia 82 as the intermediate belt 24 advances from the second image forming unit 10*b* to the third image forming unit 10*c*. The third sensor 88 monitors the image registration indicia 82 as the intermediate belt 24 advances to the fourth image forming unit 10*d*. The second and third image sensors 86 and 88 monitor the registration indicia 82, in the same manner as hereinbefore described with respect to the first sensor 84. Thus, the second and third image sensors 86 and 88 control the timing of the write or image operations of the third and fourth image forming units 10*c–d*, respectively. The second and third sensors 86 and 88 also can control the transfer timing of the third and fourth images 94 and 96, respectively, though control of the speed at which the intermediate belt 24 advances. Thus, the second and third sensors 86 and 88 assure correct registration of the third and fourth visible (magenta and cyan toner) images 94 and 96, respectively, onto the preceding first and second visible images 80 and 92 placed upon the intermediate belt 24. Thereby, the multi-layer combination of color images 80, 92, 94 and 96 are formed into one multicolor image.

Preferably, the length of the photoreceptors 12*b–d* is shorter than the preceding photoreceptor 12*a* so as to avoid contacting the image registration indicia 82 to prevent the smearing or smudging thereof.

Continuing with the discussion of FIG. 1, when superimposition of the four color toner images is completed on the intermediate belt 24, the intermediate belt 24 is moved onto the transfer station 98, where the multicolored image is transferred to a sheet of support paper or copy sheet (sheet) 100. The transfer is achieved by moving the sheet 100 of support material into contact with the multicolor toner image. The sheet of support material 100 is advanced to the transfer station 98 by a conventional sheet feeding apparatus (not shown). Preferably, the sheet feeding apparatus includes a feed roll contacting the upper most sheet 100 of a stack of copy sheets. Feed rollers rotate so as to advance the uppermost sheet 100 from the stack into contact with intermediate belt 24 in a timed sequence so that the toner powder images thereon contact the advancing sheet 100 at the transfer station 98.

Transfer station 98 includes a corona generating device which sprays ions of a suitable polarity onto the backside of the sheet 100. The corona device attracts the charged toner powder images from the intermediate belt 24 to the sheet 100. After transfer, the sheet 100 continues to move, in the direction of arrow 102, to a detacking station 104, where the sheet 100 is separated from the intermediate belt 24.

Once the copy sheet 100 is separated from the intermediate belt 24 at detacking station 104, sheet 100 is advanced to fusing station 106. Fusing station 106 permanently affixes the transferred powder image to the sheet 100. Preferably, fusing station 106 comprises a heated fuser roller 108 and a back-up roller 110 with the toner powder image contacting fuser roller 108. In this manner, the toner powder image is permanently affixed to the sheet 100. After fusing, a chute (not shown) guides the advancing sheet 100 to a catch tray (not shown) for subsequent removal from the printing machine by the operator.

After the sheet 100 is separated from intermediate belt 24 at the detacking station 104, the intermediate belt 24 continues to advanced to the cleaning station 112. The cleaning station 112 cleans the intermediate belt 24 to remove the image registration indicia and wrong sign toner particles carried by the non-image areas on the intermediate belt 24 as well as residual toner particles remaining from the multicolor image carried by the image areas on the intermediate belt 24. The cleaning station 112 can be any conventional apparatus. For example, a cleaning roller, formed of any appropriate synthetic resin, can be driven in a direction opposite to the direction of the intermediate belt 24 for cleaning thereof. Such a cleaning apparatus would function in the same manner as previously discussed with respect to cleaning station 22*a–d*. Subsequent to the cleaning, an AC neutralization corotron 114 floods the intermediate belt 24 to dissipate any residual electrostatic charge remaining prior to the beginning of the next cycle.

Alternatively, in another embodiment, the receiving member may be a sheet of support material. In this embodiment, the sheet of of support material is advanced by a belt to successive transfer stations where a visible (toner) images is transferred in superimposed registration with a visible (toner) image from the preceding station. After all of the images are transferred to the sheet of support material, the resulting multi-layered visible (toner) image formed thereon is fused to the sheet of support material.

Figure 4:
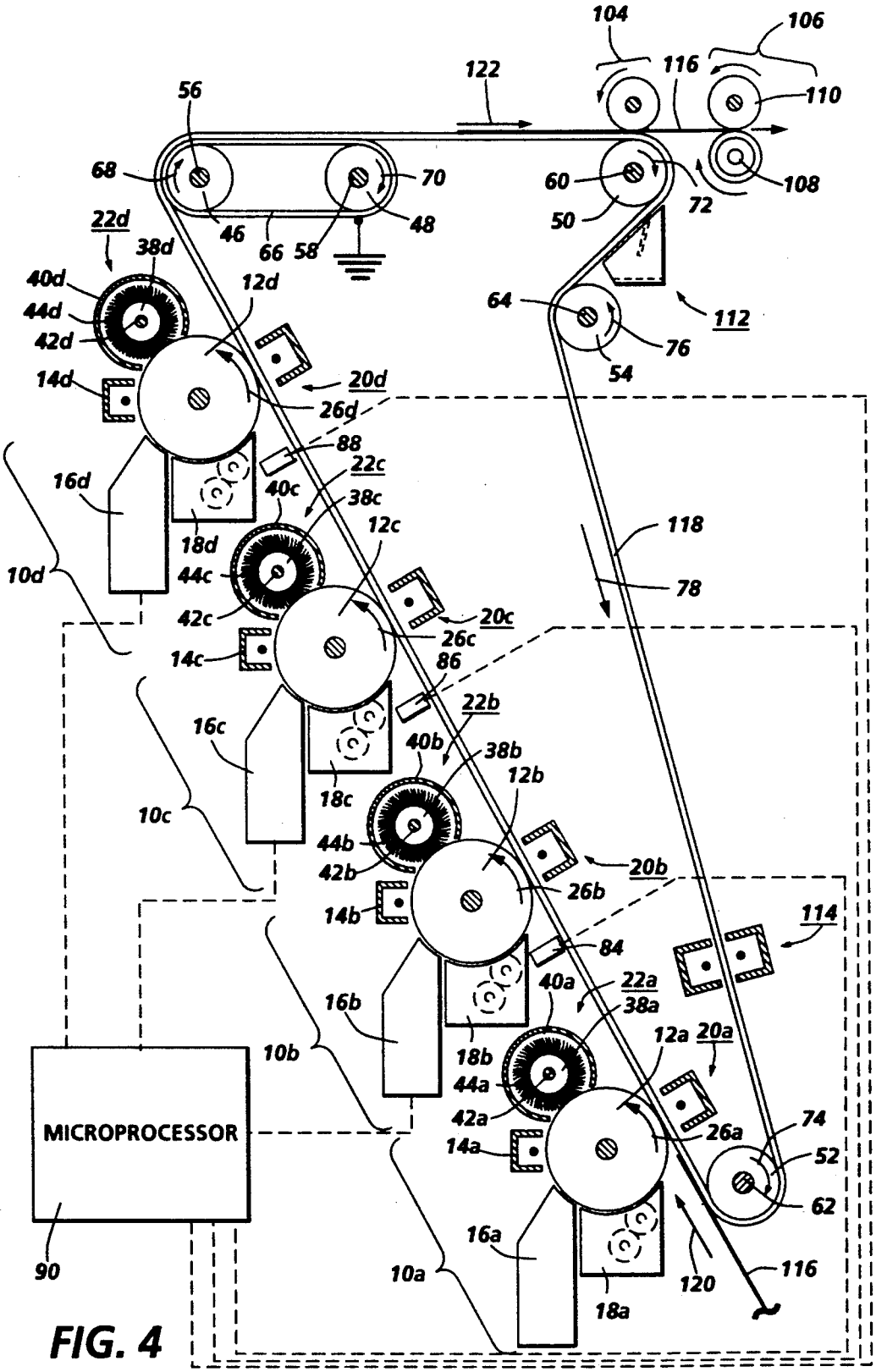
FIG. 4 is a schematic elevational view of an alternative embodiment of the present invention.

By way of example, such an alternative embodiment is illustrated in FIG. 4 and has like numeric designations for components of like function of the previous discussed embodiment. A sheet 116 of support material is advanced onto a transport belt 118 by a conventional sheet feeding apparatus (not shown). Preferably, the sheet feeding apparatus includes a feed roll contacting the upper most sheet 116 of a stack of copy sheets. Feed rollers rotate so as to advance the uppermost sheet 116 from the stack into contact with a transport belt 118 in a timed sequence. In this way, the leading edge of the sheet 116 arrives at a preselected position. The sheet can be secured to the transport belt 118 by several ways such as electrostatically tacking the sheet 116 thereto or closing an open gripper which receives the sheet 116. Once the sheet 116 is secured, the transport belt 118 can then carry the sheet 116 for movement therewith.

As the transport belt 118 moves in the direction of arrow 120, the sheet 116 of support material passes, in successive order to image forming units 10*a–d*, each of which functions in the same manner as in the previously discussed embodiment. At a transfer station 20*a* of the image forming unit 10*a*, a first visible image and image registration image are transferred to the sheet 116 and the transport belt 118, respectively. The transport belt is formed of a suitable dielectric material enabling the transfer of the image registration indicia thereto. At transfer stations 20*b–d*, of respective image forming units 10*b–d*, second, third, and fourth visible images are transferred, respectively therefrom, to the sheet 116 in superimposed registration over the visible images of the preceding transfer stations. The registration of the visible images is provided in the same manner as in the previously discussed embodiment.

For example, as the transport belt 118 advances, the registration indicia pass beneath registration sensors 84, 86 and 88 disposed, respectively, between successive image forming units. Each of the sensors 84, 86 and 88 monitors the image registration and provides a control signal at the detection of each line indicative of the indicia pattern to a microprocessor 90. The microprocessor 90, responsive thereto, functions to adjust the timing of the transfer of the images of the later image forming units. This assures correction registration of the first, second, third and fourth visible images so as to form a multi-layered multicolor image therefrom.

After transfer of the fourth visible image, the sheet 116 continues to move, in the direction of arrow 122, to a detacking station 104. Prior to or at the detacking station 104, the sheet 116 is released from the belt 118 enabling the detacking station 104 to separate the sheet 116 from the transport belt 118.

Once the copy sheet 116 is separated from the transport belt 118, the sheet 116 advances to a fusing station 106. Fusing station 106 permanently affixes the transferred multi-layered multicolor image to the sheet 116. After fusing, a chute (not shown) guides the advancing sheet 116 to a catch tray (not shown) for subsequent removal from the printing machine by the operator.

After the sheet 116 is separated from the transport belt 118, the transport belt 118 advances to the cleaning station 112. At the cleaning station 112, the image registration indicia and any other residual toner particles carried by the non-image areas on the transport belt 118 are removed therefrom. Subsequent to cleaning, an AC neutralization corotron 114 floods the transport belt 118 to dissipate any residual electrostatic charge remaining prior to the beginning of the next cycle.

The apparatus of the present invention has useful functions apart from just image registration correction. Generally, electrophotographic apparatuses utilize encoders, usually an optical encoder to monitor and control the speed of the conveying belt. Typically, the optical encoder is placed about a drive rod which extends from a driving motor to a roller which drives a receiving member. The optical encoder generally comprises a disc having either slits or spaced apart line markings to form an interval pattern. A photoemitter/-photosensor can generate and monitor a pattern of light reflection or transmission to determine the rotational speed of the encoder. Since the encoder is placed about the drive rod the speed of the encoder is the same as the speed at which the motor drives the belt.

The apparatus of the present invention provides an alternative to the use of conventional encoders. As hereinbefore described with reference to FIG. 2 (or FIG. 4), the sensors 84, 86 and 88 can sense the registration indicia 82 to monitor the speed of the intermediate belt 24. Each of the sensors 84, 86 and 88 sends a signal carrying data about the speed of the intermediate belt 24 (or if such is the case, the transport belt 118). The microprocessor 90, in turn, compares the sensed speed to a desired speed and determines if a correction signal is necessary. If desired, the microprocessor 90 produces a correction signal which is sent to the motor (not shown) which drives the intermediate belt 24. In this manner the speed of the intermediate belt 24 can be adjusted without the use of a conventional encoder.

In recapitulation, it is evident that the image registration system of the present invention forms and senses image registration indicia to control a subsequent transfer of a visible image. Visible image registration indicia are formed on a first photoconductive member and subsequently transferred to a receiving member. A visible image is formed on a second photoconductive member. A sensor senses the visible image registration indicia and generates a control signal indicative thereof. The visible image is transferred, in a manner responsive to the control signal of the sensor, to the receiving member. The image registration system is particularly advantageous in a color system wherein different colored images from successive respective photoconductive members can be transferred in accurate superimposed registration onto a receiving member to form a multicolor image thereon.

It is, therefore, apparent that there has been provided in accordance with the present invention, an image registration system that fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for providing image registration, comprising:

a receiving member;

a first photoreceptor;

first means for forming a first visible image and image registration indicia on said first photoreceptor;

first means for transferring the first visible image and the visible image registration indicia from said first photoreceptor to the receiving member;

a second photoreceptor;

second means for forming a second visible image on said second photoreceptor;

means for sensing the visible image registration indicia on said receiving member and generating a control signal indicative thereof; and second means, responsive to the signal from said sensing means, for transferring the second visible image from said second photoreceptor to said receiving member.

2. An apparatus according to claim 1, wherein the second visible image is formed of a different color than the first visible image.

3. An apparatus according to claim 1, wherein:

said first transferring means transfers the first visible image to said receiving member; and said second transferring means transfers the second visible image to said receiving member in superimposed registration with the first visible image.

4. An apparatus according to claim 1, further including means for fusing the first visible image to said receiving member.

5. An apparatus according to claim 1, further including third means for transferring the first visible image from said receiving member to a sheet of support material.

6. An apparatus according to claim 5, further including means for fusing the first visible image to the sheet of support material.

7. An apparatus according to claim 1, wherein said first transferring means transfer the visible image registration indicia to a region of said receiving member spaced from the first visible image transferred thereto.

8. An apparatus according to claim 1, wherein said first transferring means transfers the visible image registration adjacent at least one side of the first visible image and extending substantially the full length thereof, whereby said sensing means is able to generate a control signal indicative of the entire first visible image.

9. An apparatus according to claim 1, further including means, responsive to the control signal of said sensing means, for moving said receiving member at a variable speed.

10. An apparatus according to claim 1 wherein said sensing means is positioned intermediate said first photoreceptor and said second photoreceptor.

11. An apparatus according to claim 1, wherein said first photoreceptor is spaced from the visible image registration indicia to prevent smearing and smudging thereof.

12. An apparatus according to claim 1, wherein said sensing means includes an optical sensor for sensing the visible image registration indicia.

13. An apparatus according to claim 1, wherein said sensing means includes a magnetic sensor for sensing the visible image registration.

14. An apparatus according to claim 1, wherein said second forming means forms the visible image registration in a pattern of spaced apart lines.

15. An apparatus according to claim 1, wherein said first forming means includes:

means for recording electrostatic latent image registration indicia on first photoreceptor; and means for developing the electrostatic latent image registration indicia to generate the visible image registration indicia.

16. An electrophotographic printing system of the type in which image registration is provided for a visible image formed on a photoreceptor and transferred to a receiving member, wherein the improvement comprises:

a first photoreceptor;

first means for forming a first visible image and image registration indicia on said first photoreceptor;

first means for transferring the first visible image and the visible image registration indicia from said first photoreceptor to the receiving member;

a second photoreceptor;

second means for forming a second visible image on said second photoreceptor;

means for sensing the visible image registration indicia on said receiving member and generating a control signal indicative thereof; and second means, responsive to the signal from said sensing means, for transferring the second visible image from said second photoreceptor to said receiving member.

17. An apparatus according to claim 16, wherein the second visible image is formed of a different color than the first visible image.

18. An apparatus according to claim 16, wherein:

said first transferring means transfers the first visible image to said receiving member; and said second transferring means transfers the second visible image to said receiving member in superimposed registration with the first visible image.

19. An apparatus according to claim 16, further including means for fusing the first visible image to said receiving member.

20. An apparatus according to claim 16, further including third means for transferring the first visible image from said receiving member to a sheet of support material.

21. An apparatus according to claim 20, further including means for fusing the first visible image to the sheet of support material.

22. An apparatus according to claim 16, wherein said first transferring means transfer the visible image registration indicia to a region of said receiving member spaced from the first visible image transferred thereto.

23. An apparatus according to claim 16, wherein said first transferring means transfers the visible image registration adjacent at least one side of the first visible image and extending substantially the full length thereof, whereby said sensing means is able to generate a control signal indicative of the entire first visible image.

24. An apparatus according to claim 16, further including means, responsive to the control signal of said sensing means, for moving said receiving member at a variable speed.

25. An apparatus according to claim 16, wherein said sensing means is positioned intermediate said first photoreceptor and said second photoreceptor.

26. An apparatus according to claim 16, wherein said first photoreceptor is spaced from the visible image registration indicia to prevent smearing and smudging thereof.

27. An apparatus according to claim 16, wherein said sensing means includes an optical sensor for sensing the visible image registration indicia.

28. An apparatus according to claim 16, wherein said sensing means includes a magnetic sensor for sensing the visible image registration.

29. An apparatus according to claim 16, wherein said second forming means forms the visible image registration in a pattern of spaced apart lines.

30. An apparatus according to claim 1, wherein said first forming means includes:

means for recording electrostatic latent image registration indicia on said first photoreceptor; and means for developing the electrostatic latent image registration indicia to generate the visible image registration indicia.

* * * * *